US007316146B2

(12) United States Patent
Seilinger et al.

(10) Patent No.: US 7,316,146 B2
(45) Date of Patent: Jan. 8, 2008

(54) ROLLING STAND FOR PRODUCING ROLLED STRIP

(75) Inventors: Alois Seilinger, Linz (AT); Andeas Mayrhofer, Pucking (AT); Alexander Kainz, Linz (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 350 days.

(21) Appl. No.: 10/489,593

(22) PCT Filed: Sep. 2, 2002

(86) PCT No.: PCT/EP02/09764

§ 371 (c)(1),
(2), (4) Date: Oct. 1, 2004

(87) PCT Pub. No.: WO03/022470

PCT Pub. Date: Mar. 20, 2003

(65) Prior Publication Data

US 2005/0034501 A1 Feb. 17, 2005

(30) Foreign Application Priority Data

Sep. 12, 2001 (AT) ..... A 1433/2001

(51) Int. Cl.
*B21B 27/02* (2006.01)

(52) U.S. Cl. ..... 72/252.5; 72/243.6; 72/247

(58) Field of Classification Search ..... 72/252.5, 72/247, 243.6

See application file for complete search history.

(56) References Cited

U.S. PATENT DOCUMENTS 3,857,268 A * 12/1974 Kajiwaka ..... 72/247
4,519,233 A * 5/1985 Feldmann et al. ..... 72/241.4
4,781,051 A * 11/1988 Schultes et al. ..... 72/247
4,955,221 A * 9/1990 Feldmann et al. ..... 72/247
5,218,852 A * 6/1993 Watanabe et al. ..... 72/241.4
5,622,073 A * 4/1997 Hiruta et al. ..... 72/247

FOREIGN PATENT DOCUMENTS

| | | |
|---|---|---|
| DE | 36 20 197 | 12/1987 |
| EP | 0 049 798 | 4/1982 |
| EP | 0 091 540 | 10/1983 |
| EP | 0 294 544 | 12/1988 |
| EP | 0 401 685 | 12/1990 |

* cited by examiner

OTHER PUBLICATIONS

U.S.Patent 4,440,012 corresponds to EPO 049 798.
U.S. Patent 4,881,396 corresponds to EP 294 544.
U.S. Patents 4,800,742 and 4,955,221 correspond to DE 36 20 197 A1.
International Search Report.

*Primary Examiner*—Derris H. Banks
*Assistant Examiner*—Debra M Wolfe
(74) *Attorney, Agent, or Firm*—Ostrolenk, Faber, Gerb & Soffen, LLP

(57) ABSTRACT

In the case of a rolling stand for producing rolled strip, which is provided with rolls which are axially displaceable with respect to one another, have a curved contour running over the entire effective barrel length and complement one another exclusively in a specific relative axial position of the rolls in the unloaded state, it is intended for the thickness profile of the roll gap over the active roll barrel length to be varied by axial displacement of the rolls provided with a roll barrel contour in relation to one another in such a way that a strip that is planar and free from undulations is obtained. This takes place by the profile of the barrel contour of the rolls of a pair of rolls being formed by a trigonometric function and the roll gap contour also being formed by a trigonometric function in dependence on the profile of the barrel contour and the position of the rolls within the axial displacement region.

28 Claims, 9 Drawing Sheets

Fig. 1
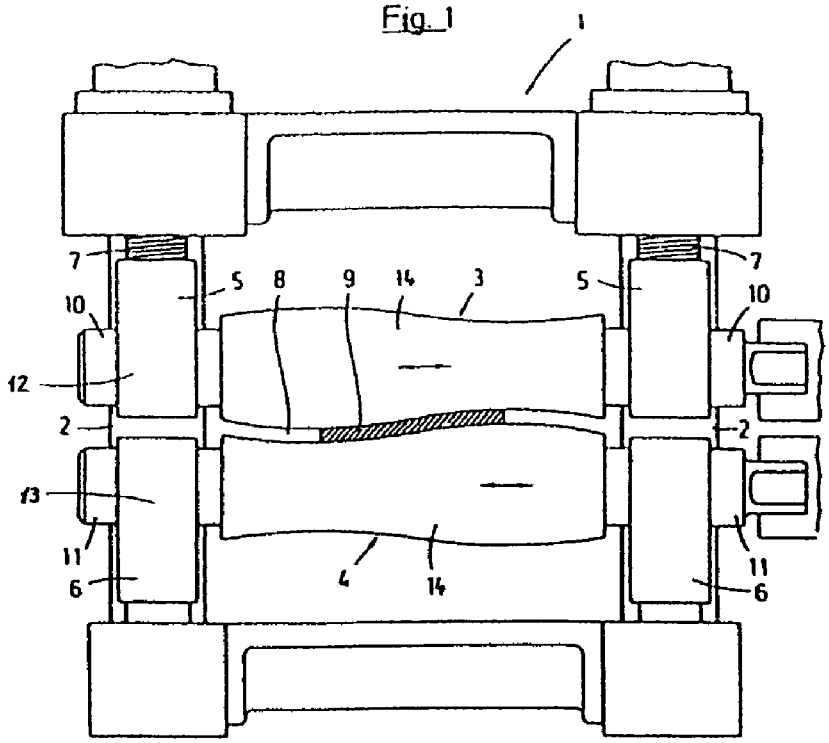
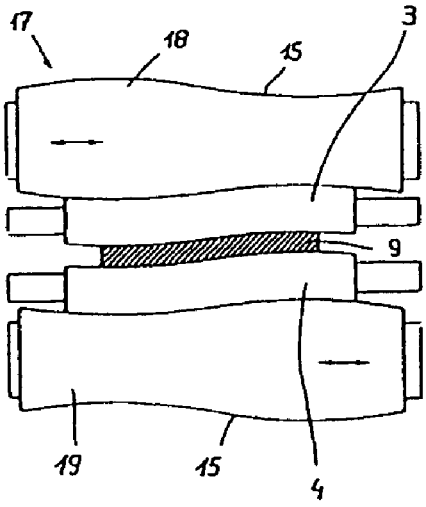
Fig. 2
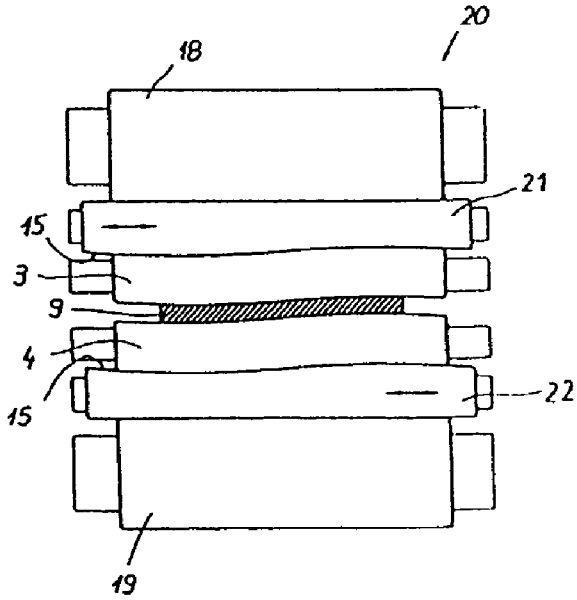
Fig. 3

Definition of the contour angle

ROLLING STAND FOR PRODUCING ROLLED STRIP

BACKGROUND OF THE INVENTION

The invention relates to a rolling stand for producing rolled strip, with work rolls which are supported if appropriate on backup rolls or backup rolls and intermediate rolls. The work rolls and/or backup rolls and/or intermediate rolls are arranged such that they are axially displaceable with respect to one another in the rolling stand. Each roll of at least one of these pairs of rolls has curved contour running over the entire effective barrel length. These two barrel contours exclusively complement one another at a specific axial position of the rolls of the pair of rolls with respect to each other and in the unloaded state.

To produce a planar rolled strip with a defined cross-sectional profile, it is necessary to set contour-influencing measures, such as for example the use of roll bending devices, with which the application of rolling force to the strip and the distribution of the exiting thickness over the width of the strip can be influenced in a specifically selective manner.

EP-B 0 049 798 already discloses a rolling stand of the generic type in which the form of the roll gap, and consequently the surface contour of the rolled strip, is influenced exclusively by the axial displacement of the rolls formed with curved contours. The two interacting rolls of a pair of rolls have an identical form, are installed in 180° opposition and complement one another in a specific axial displacement position. This particular camber of the rolls makes it possible to compensate for the parabolic roll barrel bending under load, which is dependent on the respective loading conditions, so that a roll change necessary when there is a significant change in the loading conditions, which is quite customary in the case of rolls with a parabolic roll barrel camber, is no longer needed. In EP-B 294 544 it is pointed out that the parabolic bending determined essentially by quadratic components can be compensated by axially displaceable rolls with the described roll contour, but excessive stretching in the edge areas or in the quarter areas of the rolled strip can lead to undulations in the edge or quarter area. Although these disadvantages could be overcome with additional roll bending devices, expediently in combination with zone cooling, major advantages of rolls contoured in such a way would be lost again as a result.

According to EP-B 294 544, to avoid this formation of undulations at the edge or quarter area on the rolled strip, it is proposed that the roll barrel contours of the rolls complementing one other in an axial displacement position are formed by a curve of the fifth order, the respective curves being placed on the rolls in such a way that, in a neutral roll position, they have a maximum and minimum of the inclination of the curves respectively in linear regions situated on either side of the center.

SUMMARY OF THE INVENTION

The object of the present invention is to provide a further advantageous solution for a rolling stand in which the form of the roll gap, i.e. the thickness profile of the roll gap over the active roll barrel length, can be varied by axial displacement of the rolls provided with a roll barrel contour in relation to one another in such a way that a strip which meets the highest quality requirements, is planar and free from undulations is obtained.

This object is achieved according to the invention by the profile of the barrel contour of the rolls of a pair of rolls being formed by a trigonometric function and the roll gap contour also being formed by a trigonometric function in dependence on the profile of the barrel contour and the position of the rolls within the axial displacement region.

Tests have shown that good results can be obtained if the trigonometric function of the barrel contour is formed by a sine function and the roll gap contour is formed by a cosine function derived from said sine function. The barrel contour in this case follows the general equation $$R(x) = R_0 + A * \sin\left(\frac{2 * \varphi * (x + c)}{L_{REF}}\right)$$

where

R is the radius of the roll x is the axial position with respect to the center of the roll (=distance from the center of the roll)

$R_0$ is the roll radius offset (=radius of the roll at the contour inflection point)

A is the contour coefficient $\phi$ is the contour angle c is the contour displacement $L_{REF}$ is the camber reference length The roll gap contour in this case follows the general equation $$G(x, s) = G_0 + 2 * A * \cos\left(\frac{2 * \varphi * x}{L_{REF}}\right) * \sin\left(\frac{2 * \varphi * (s - c)}{L_{REF}}\right)$$

where s is the displacement of the upper roll from the central position $G_0$ is the roll gap offset and is obtained from the contour equations of the two roll barrels with the inclusion of the displacement distance (s) of one of the rolls from the central position.

The contour coefficient A is in this case determined by the axial displacement region and the corresponding equivalent roll cambers in the extreme positions of the rolls. Equivalent camber is understood in this case as meaning that camber of conventional rolls provided with a cosine camber which together generate exactly the same idle roll gap profile.

By varying the contour angle $\phi$, which relates to half the camber reference length, the current roll contour, and consequently the profile of the roll gap, can be influenced without changing the equivalent cambers of the rolls. The positive effect with regard to avoidance of the formation of undulations in the quarter area is obtained, because an increase in the contour angle leads to a decrease in the roll barrel diameter in the region between the edge of the roll and the center of the roll, whereby ultimately a smaller rolling deformation occurs in this region that is critical for the formation of undulations in the quarter area.

A particularly advantageous configuration of a rolling stand is obtained if the trigonometric function of the barrel contour is formed by a tilted sine function corresponding to the general equation $$R(x) = R_0 + A * \sin\left(\frac{2 * \varphi * (x + c)}{L_{REF}}\right) + B * (x + c)$$

where

B is the tilting coefficient and the roll gap contour is formed by a cosine function derived from said sine function in a manner corresponding to the general equation $$G(x, s) = G_0 + 2 * A * \cos\left(\frac{2 * \varphi * x}{L_{REF}}\right) * \sin\left(\frac{2 * \varphi * (s - c)}{L_{REF}}\right) + 2 * B * (s - c)$$

where s is the displacement of the upper roll from the central position $G_0$ is the roll gap offset.

By inserting the linear element B*(x+c) into the equation for the barrel contour, tilting of the sine function is made possible and, by suitable choice of the coefficient (B), minimizing of the differences in diameter along the barrel contour is achieved. The minimizing of the differences in diameter along the effective length of the roll barrel achieved by the tilted sine function leads at the same time to a reduction in the axial forces dissipated into the roll supporting bearings during the rolling operation. In the case of rolling stands which are equipped with backup rolls in addition to the work rolls provided with a barrel contour, the optimization of the tilting coefficient leads to a reduction in the maximum local contact pressures on the backup rolls, or generally to a more uniform distribution of forces on the neighbouring rolls. The tilting coefficient (B) consequently brings about a smoothing of the contour profile on the roll barrel and of the distribution of forces. Consequently, although the introduction of a tilting coefficient into the contour equation of the roll barrels favorably influences the loading to which the rolls and bearings of the rolling stand are subjected, it does not exhibit any fundamental influence on the roll gap geometry, as shown by the comparison of the two roll gap equations based on a sine function and a tilted sine function for the roll barrel contour.

As can be seen from the above formula for G(x,s), the two barrel contours complement one another when the displacement of the upper work roll corresponds to the contour displacement c and at the same time there is an equal and opposite displacement of the lower work roll by s=−c. This position may in this case lie both inside and outside the working range of the axial displacement.

An advantageous configuration of the curved barrel contour is obtained if, with a given camber reference length ($L_{REF}$) for the curved barrel contour of the roll, a contour angle (ϕ) corresponding to the condition $0° < \phi \leqq 180°$, preferably $50° \leqq \phi \leqq 80°$, is chosen. This ensures that, starting from the central maximum or minimum value, the roll gap constantly decreases or increases to the edges of the roll depending on the chosen direction of displacement. In the case of a contour angle $\phi > 180°$, there is a reversal in the constant decrease or increase of the roll gap in the edge region of the camber reference length, and consequently undesired influences on the quality of the roll strip. If the contour angle approaches the value ϕ=0, there is an asymptomatic trend toward the formation of a parabolic roll gap contour.

There is an approximation to minimizing the axial forces to be dissipated into the roll supporting bearings when the tilting coefficient (B) in the equation for the barrel contour of each roll is chosen such that the maximum difference in diameter of the barrel contours within the camber reference length or the barrel length is at a minimum.

Influencing the rolls in such a way as to improve the quality of the strip can be obtained if further actuators, influencing the barrel contour at least in certain portions, are additionally positioned in the rolling stand in operative connection with the work rolls and/or backup rolls and/or intermediate rolls, such as for example work roll cooling or zone cooling. Corresponding effects may also be realized by roll bending devices or by heating devices which can be zonally switched on.

In order to ensure continuous monitoring and influencing of the quality of the strip, inclusion of the rolling stand in a profile or flatness control circuit is envisaged. This is achieved by the work rolls and/or backup rolls and/or intermediate rolls being connected to a control device for profile or flatness control by the displacing devices assigned to them, and also if appropriate necessary measuring devices for sensing the state of the strip running in or running out and, if appropriate, additional actuators, by the control device being assigned a computing unit, which uses mathematical models, if appropriate uses a neural network, to generate control signals for the correction of the work rolls and/or backup rolls and/or intermediate rolls and, if appropriate, additional actuators, and actuating elements assigned to the work rolls and/or backup rolls and/or intermediate rolls and if appropriate additional actuators can be used to move them to positions corresponding to the control signals. The measuring devices are used to acquire strip-specific data, such as for example profile variation, stress conditions, temperature profiles and rolling forces.

BRIEF DESCRIPTION OF THE DRAWINGS

Further advantages and features of the present invention emerge from the description which follows of nonrestrictive exemplary embodiments, reference being made to the accompanying figures, in which:

FIG. 2 shows a schematic representation of a four-high rolling stand with backup rolls corresponding to the invention, FIG. 3 shows a schematic representation of a six-high rolling stand with intermediate rolls corresponding to the invention.

DESCRIPTION OF THE PREFERRED EMBODIMENTS

Figure 1A:
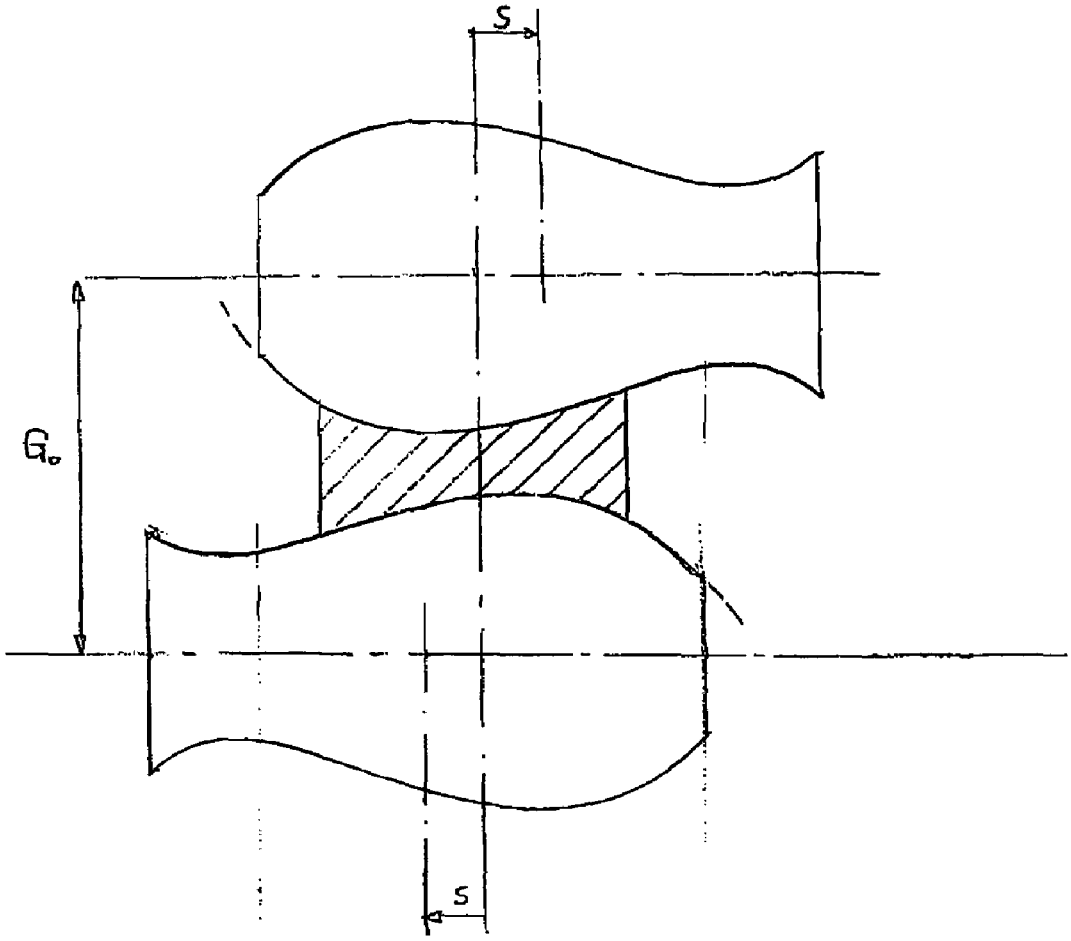
FIG. 1 shows the schematic representation of a two-high rolling stand corresponding to the invention, FIG. 1*a* schematically shows work rolls
FIG. 1*b* illustrates a roll gap contour

Various types of rolling stands that are considered for application of the invention and which have known basic structure in the prior art, for example EP-B 0 049 798, to which the invention is here applied are schematically represented in FIGS. 1 to 3.

FIG. 1 shows a two-high rolling stand 1 with stand uprights 2 and a pair of work rolls 3, 4, which are rotatably supported in chocks 5, 6 in the two stand uprights 2. Adjusting devices 7 make it possible to adjust the two work rolls 3, 4 with respect to the rolled strip 9 running through the roll gap 8. The two work rolls 3, 4 are supported in an axially displaceable manner by means of the roll necks 10, 11 in the chocks 5, 6, which also comprise displacing devices 12, 13. The roll barrels 14 of the two work rolls 3, 4 are provided with a curved barrel contour 15 over their entire effective barrel length, these barrel contours 15 complementing one another in a specific relative axial position of the work rolls in the unloaded state. This is possible either inside or outside the axial displacement region of the work rolls 3, 4.

Figure 1B:
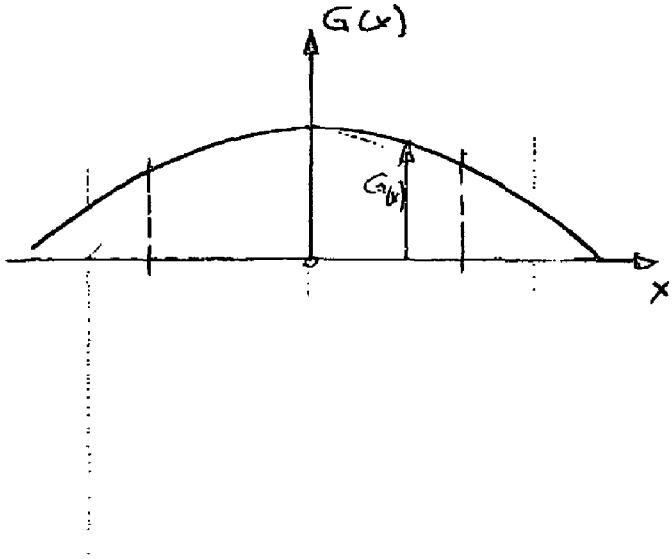

FIG. 1*a* schematically shows two work rolls in a working position and FIG. 1*b* illustrates the roll gap contour G dependent upon the displacements.

FIG. 2 shows in a further schematized representation a four-high rolling stand 17 with work rolls 3, 4 and backup rolls 18, 19. In this exemplary embodiment, the backup rolls 18, 19 are provided with a curved barrel contour 15 and are supported in an axially displaceable manner. By analogy, FIG. 3 shows a six-high rolling stand 20 with work rolls 3, 4, backup rolls 18, 19 and intermediate rolls 21, 22. In this exemplary embodiment, the intermediate rolls 21, 22 are provided with a curved barrel contour 15 and are supported in an axially displaceable manner. While in the case of the two-high rolling stand the barrel contour acts directly on the roll strip, in the case of the rolling stands according to FIG. 2 and FIG. 3 a change of the roll gap contour produced by the essentially cylindrical work rolls is brought about by the effect of the backup or intermediate rolls provided with a curved barrel contour.

In the various embodiments of FIGS. 1-3, either the work rolls may have the curved barrel contour, or the intermediate rolls, or the backup rolls, or only the outermost rolls in the respective stands of the embodiments, or all rolls in the respective stands of the embodiments. Each roll has the curved barrel contour described below.

All of the rolls, work, intermediate and backup, are of steel and are deformable under pressure during the rolling process. The rolling force during that process is high enough to deform each cylindrical roll to be contoured as described herein. The extent of the roll deformation is in the range of a few tenths of a millimeter.

Figure 4:
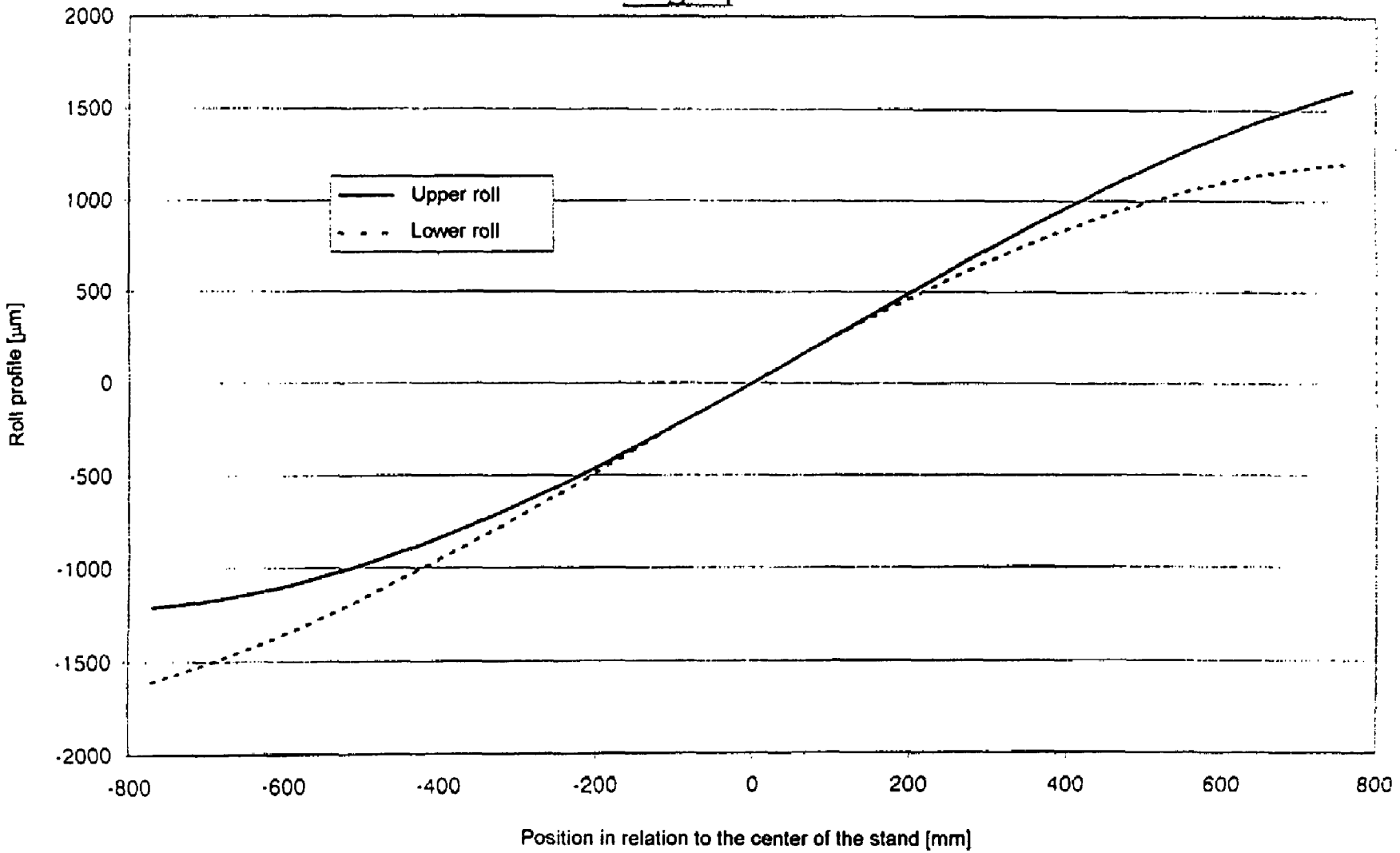
FIG. 4 shows the roll barrel contour according to the invention on the basis of a sine function.

The profile of the barrel contour of the rolls of a pair of rolls is formed by a trigonometric function, preferably a sine function, particular advantages being obtained by a barrel contour produced by a tilted sine function, these advantages lying in possible minimizing of the differences in diameter along the barrel contour. FIG. 4 shows the curved contour profile on the roll barrel of the upper and lower work rolls of a two-high rolling stand on the basis of a sine function in the case of a roll barrel length of 1540 mm and a contour angle of 72°. In the case of a work roll displacement of approximately ±60 mm, marked differences in diameter over the barrel length are already evident.

Figure 4A:
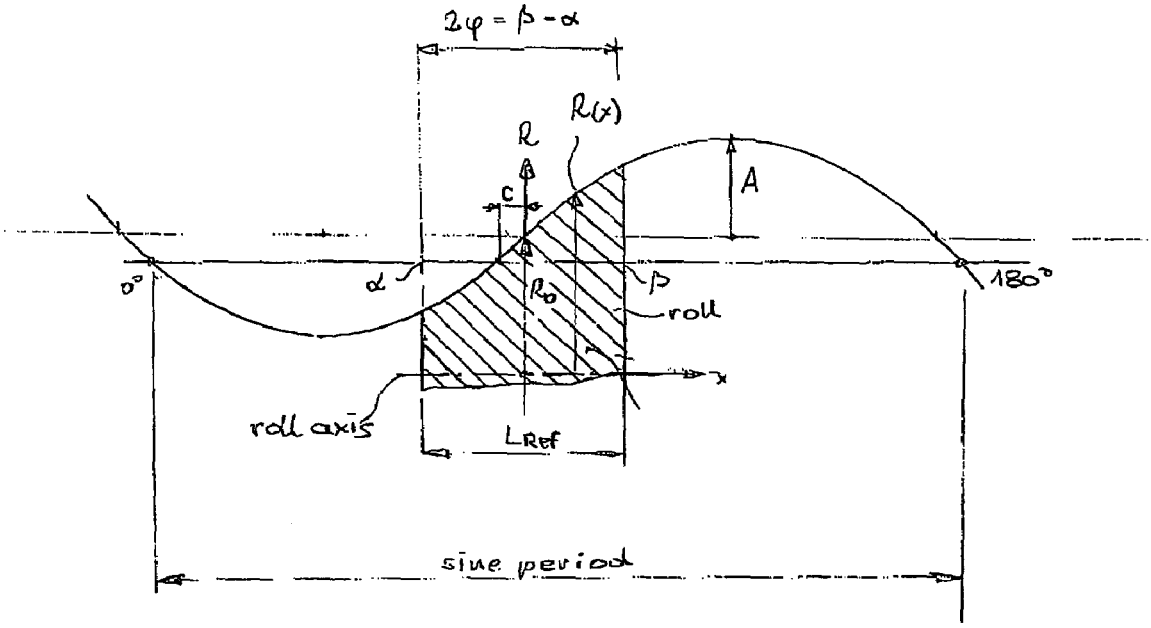
FIG. 4*a* shows part of a roll combined with a sine contour

FIG. 4*a* shows a part of a roll combined with a sine contour. It is based on a coordinate system (R,x), wherein the roll axis complies with the x-axis of the coordinate system such that the various factors of the equation above are shown.

Figure 9:
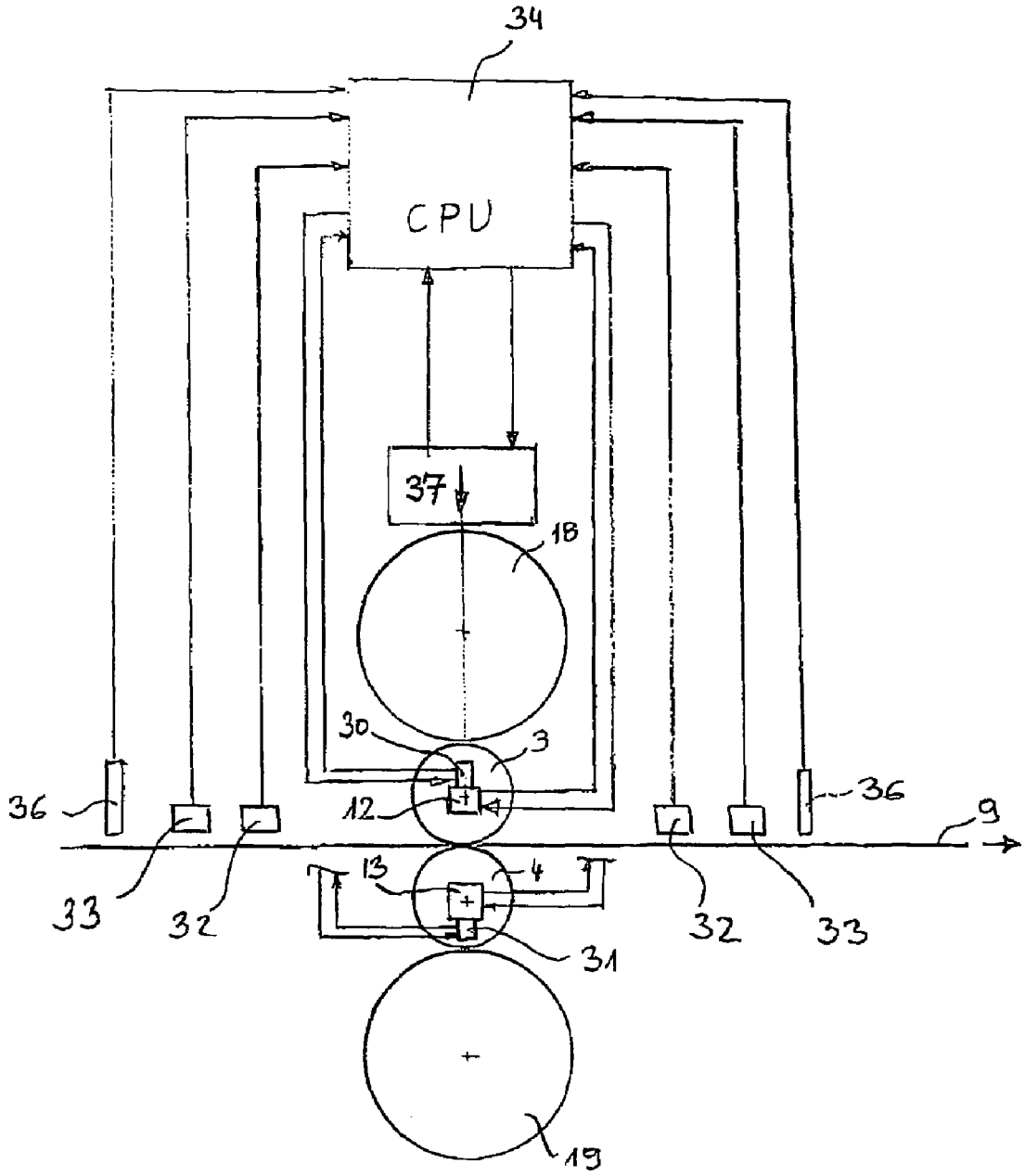

FIG. 9 shows the control device for the profile and the flatness control. In order to ensure continuous monitoring and influencing of the quality of the strip 9, inclusion of the rolling stand in a profile or flatness control circuit is envisaged. This is achieved by the work rolls 3, 4 and/or backup rolls 18, 19 and/or intermediate rolls being connected to a control device for profile 32 or flatness 33 control by the displacing devices 12, 13 assigned to them; and also if appropriate, necessary measuring devices for sensing the state of the strip running in or running out; and, if appropriate, additional actuators 30, 31, by the control device being assigned a computing unit 34, which uses mathematical models; and if appropriate uses a neural network, to generate control signals for the correction of the work rolls and/or backup rolls and/or intermediate rolls; and, if appropriate, additional actuators, 30, 31 and actuating elements assigned to the work rolls and/or backup rolls and/or intermediate rolls; and if appropriate additional actuators can be used to move them to positions corresponding to the control signals. The measuring devices are used to acquire strip-specific data, such as for example profile variation, stress conditions, temperature 36 profiles and rolling forces 37.

Figure 5:
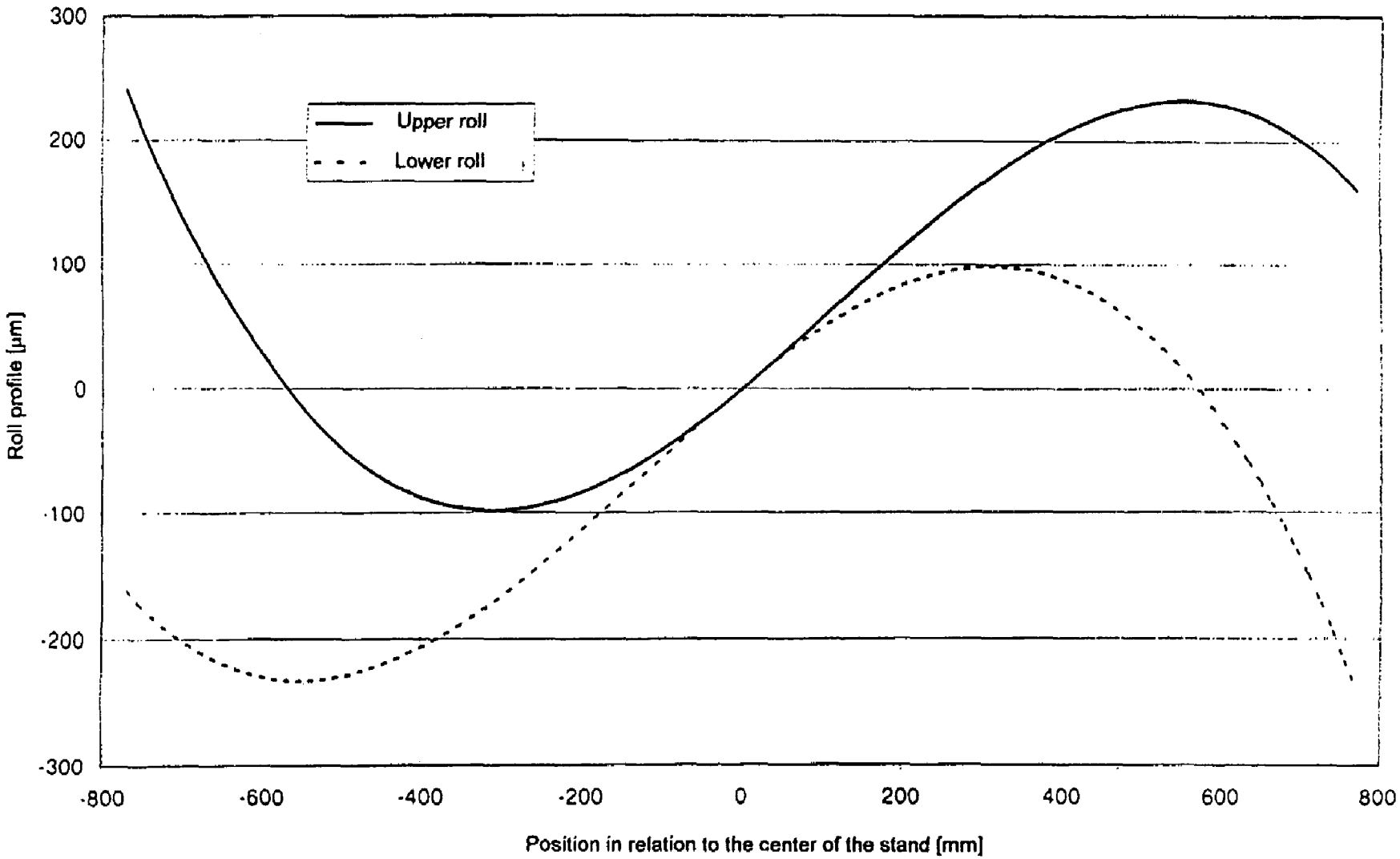
FIG. 5 shows the roll barrel contour according to the invention on the basis of a tilted sine function.

By contrast, FIG. 5 shows the curved contour profile on the roll barrel on the basis of a tilted sine function. The differences in diameter over the roll barrel length are much smaller here and illustrate the smoothing effect described. Tests have shown that, with roll barrels contoured in such a way, a rolled strip which meets the highest quality requirements, is planar and free from undulations is obtained.

Advantages exist with regard to the clearly evident input variables and the consequently easier transferability to other stand configurations. Input variables are the camber reference length or the barrel length, the displacement region, the equivalent roll cambers in the extreme displacement positions and the contour angle.

Figure 6:
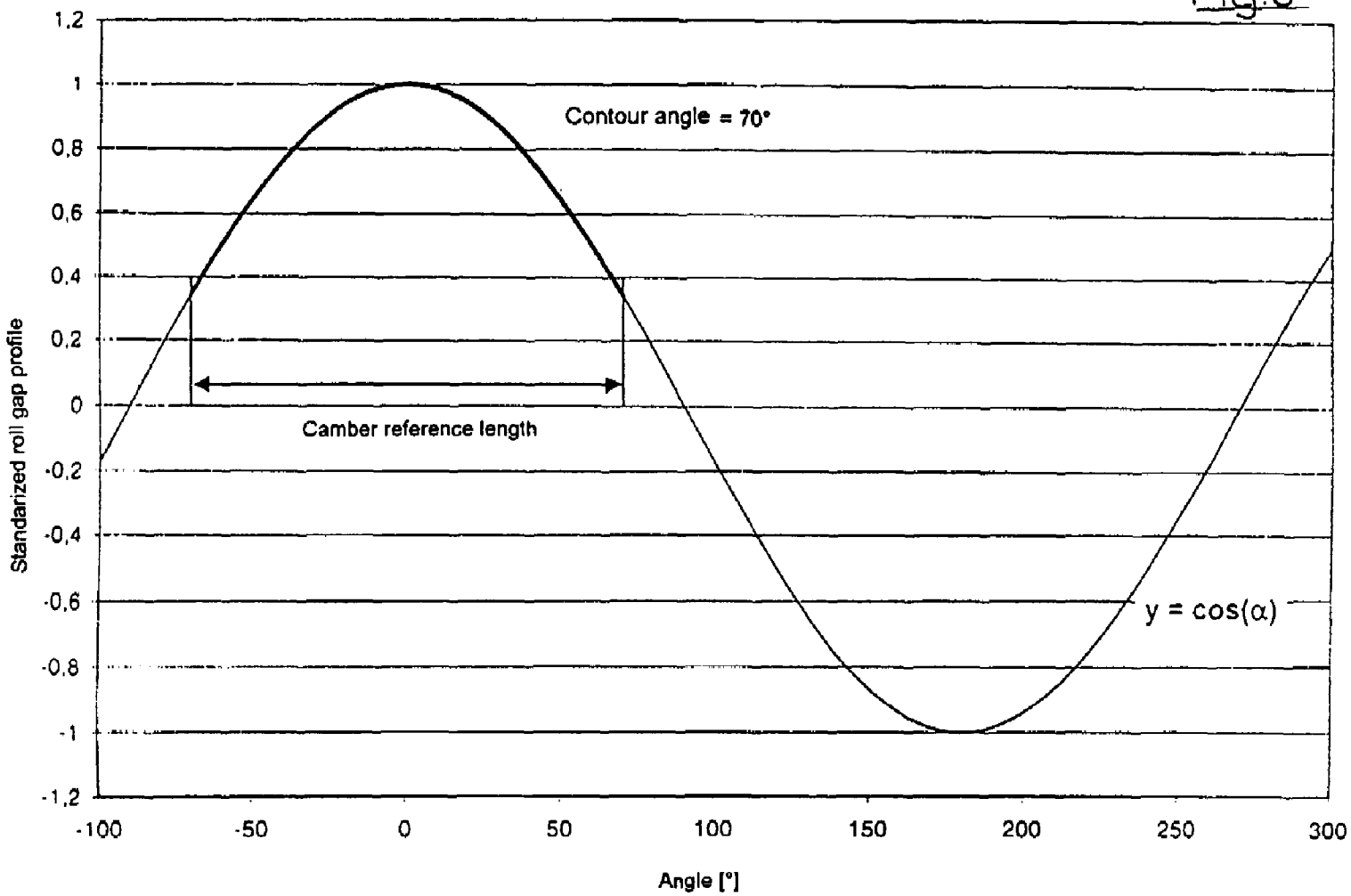
FIG. 6 shows a geometrical definition of the contour angle.

In FIG. 6, the significance of these variables for a specific standardized roll gap profile is illustrated by the example of a contour angle of 70°. The contour angle defines that section of the cosine curve that corresponds to half the camber reference length on the barrel.

Figure 7:
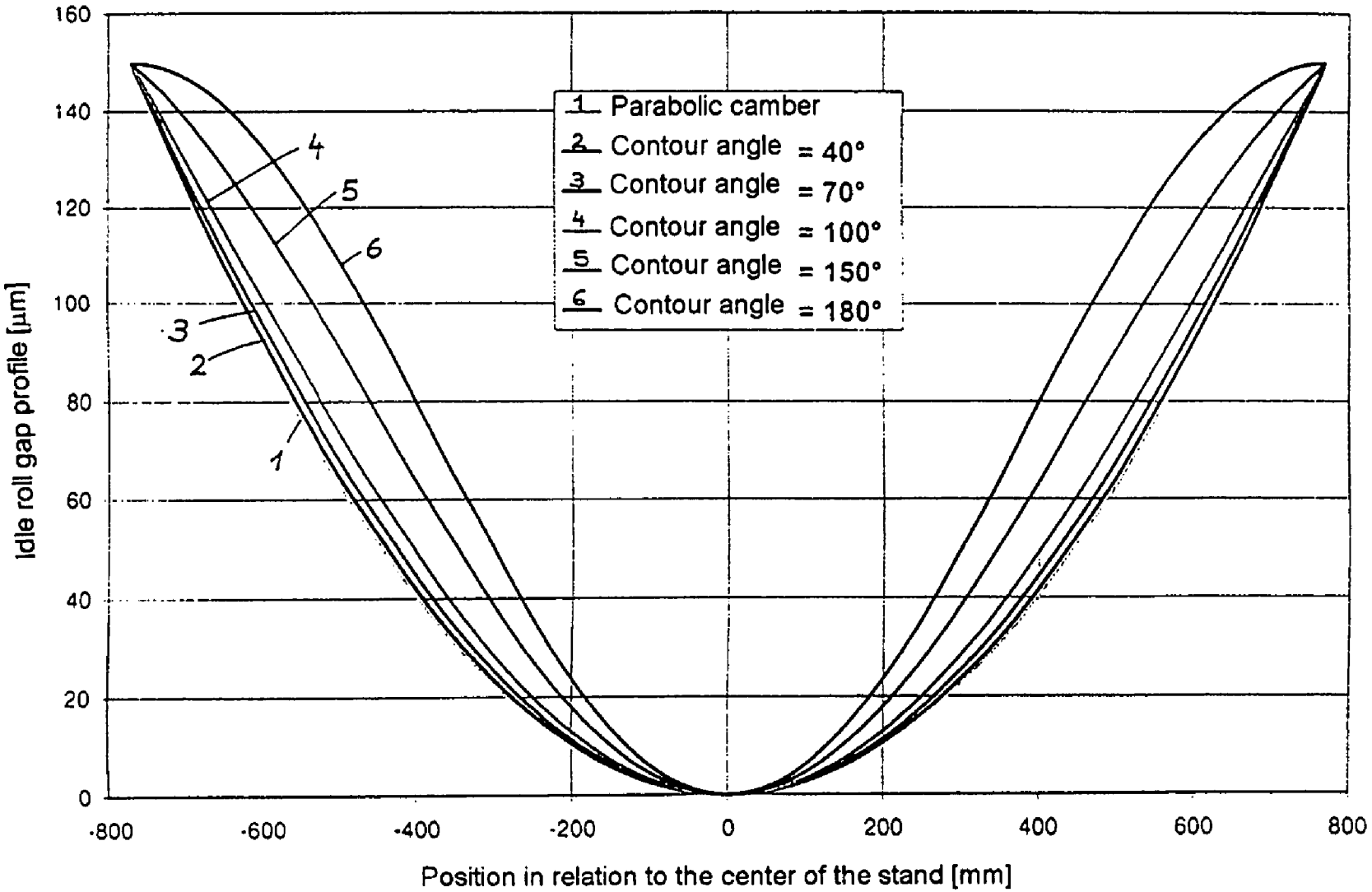
FIG. 7 shows the idle roll gap contour in dependence on the contour angle.

The barrel contour can be influenced by variation of the contour angle. The choice of a larger contour angle leads to a smaller diameter of the roll barrel in a region between the center of the roll and the edge of the roll, consequently to a smaller local degree of reduction in the roll strip thickness and ultimately a minimization of the formation of undulations in the quarter area in this region. Influence of the contour angle on the idle roll gap contour is represented in FIG. 7 and clearly shows the diameter variation in the quarter area.

Figure 8:
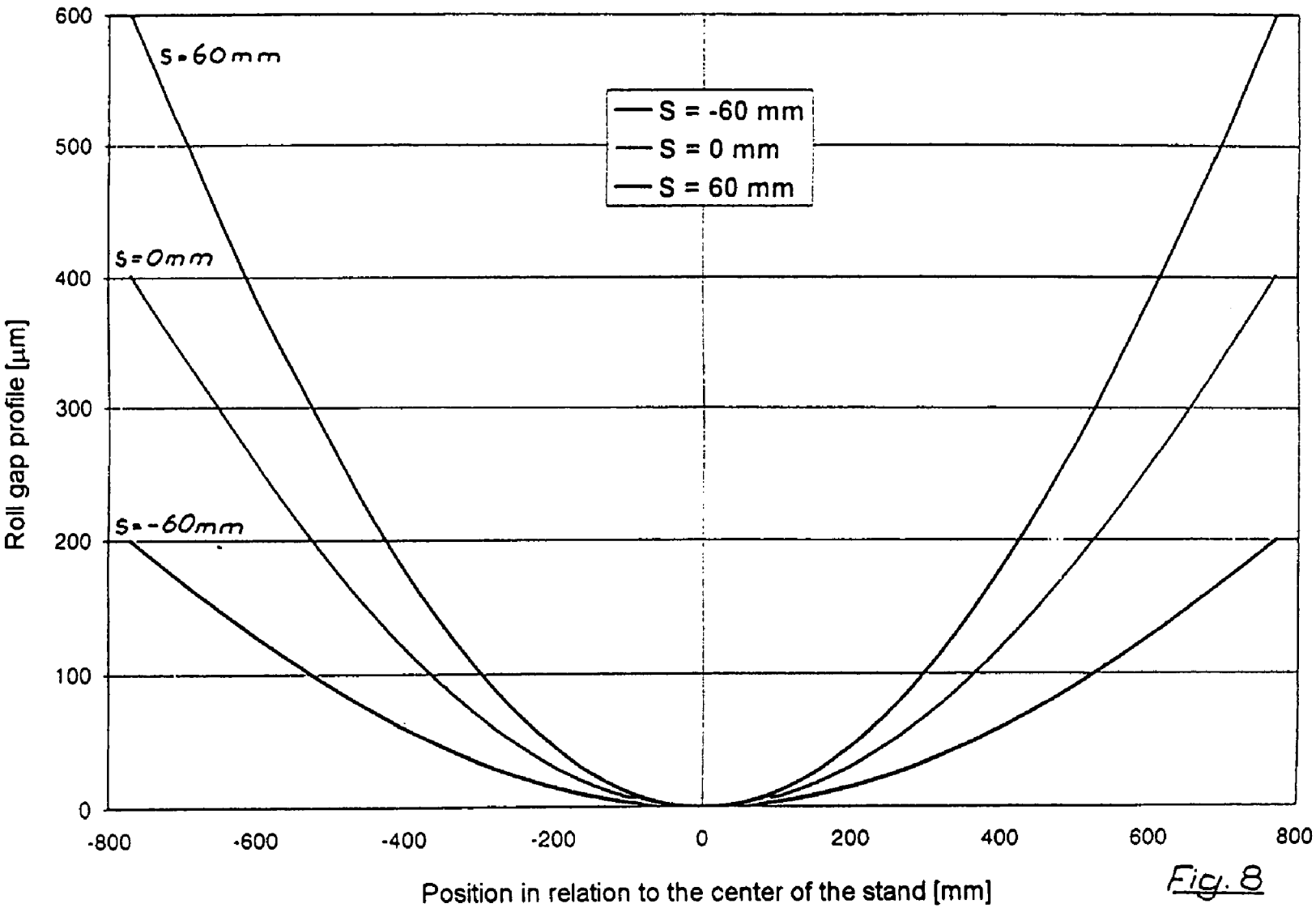
FIG. 8 shows the roll gap contour in dependence on the roll displacement s FIG. 9 schematically shows a control device for profile and flatness control.

To allow the rolls provided with the barrel contour described to be used for dynamic flatness control, the roll gap contour must be determined by the displacement position of the rolls and be continuously variable over the displacement region. These conditions are represented in FIG. 8 for three values given by way of example for the roll displacement of the upper roll (s) of −60 mm, 0 mm (no displacement) and +60 mm and show the effective range of the rolling stand that can be used.

The invention claimed is:

1. A rolling stand for producing rolling strip, comprising:

a stand for supporting rolls; two work rolls supported in the stand and oriented to define a roll gap between which a strip is rolled;

each roll of the two work rolls having a respective effective barrel length and having a respective curved barrel contour extending axially over the entire effective barrel length of the rolls, wherein the respective barrel contours complement one another when the rolls are in a specific relative axial position in an unloaded state; the rolls being supported in the stand for being axially displaceable with respect to one another;

the respective barrel contour of each of the two rolls is formed according to a trigonometric function; the roll gap between the two rolls having a contour that is also formed by a trigonometric function which is dependent upon a profile of the barrel contour and upon the axial position of the rolls within an axial displacement region thereof wherein the trigonometric function of the barrel contour is a tilted sine function corresponding to the general equation $$R(x) = R_0 + A * \sin\left(\frac{2 * \varphi * (x + c)}{L_{REF}}\right) + B * (x + c)$$

where

R is the radius of the roll x is the axial position with respect to the center of the roll (=distance from the center of the roll)

$R_0$ is the roll radius offset

A is the contour coefficient

ϕ is the contour angle c is the contour displacement $L_{REF}$ is the camber reference length B is the tilting coefficient and the roll gap contour is formed by a cosine function derived from the sine function in a manner corresponding to the general equation $$G(x, s) = G_0 \div 2 * A * \cos\left(\frac{2 * \phi * x}{L_{REF}}\right) * \sin\left(\frac{2 * \phi * (s - c)}{L_{REF}}\right) + 2 * B * (s - c)$$

where s is the displacement of the upper roll from the central position $G_0$ is the roll gap offset.

2. A rolling stand for producing rolled strip, comprising:

a stand for supporting rolls; two work rolls supported in the stand and oriented to define a roll gap between which a strip is rolled;

a pair of second rolls, each second roll being outward of and in pressing engagement on a respective one of the work rolls for urging the work rolls toward the roll gap for producing the rolled strip;

each second roll having a respective effective barrel length and having a respective curved barrel contour running over the entire effective barrel length of the second roll, wherein the respective barrel contours of each of the second rolls complement one another when the second rolls are in a specific relative axial position of the second rolls in an unloaded state;

the second rolls pressing on the work rolls for defining respective curved contours of the work rolls corresponding to the respective curved contours of the second rolls in engagement with the work rolls;

the second rolls defining the work rolls to be so shaped that the profile of the barrel contour of each of the work rolls is formed according to a trigonometric function, and defining the roll gap between the work rolls to have a contour that is also formed by a trigonometric function which is dependent upon the profile of the barrel contour of the second rolls and upon the axial position of the second rolls within an axial displacement region thereof wherein the trigonometric function of the barrel contour is a tilted sine function corresponding to the general equation $$R(x) = R_0 + A * \sin\left(\frac{2 * \varphi * (x + c)}{L_{REF}}\right) + B * (x + c)$$

where

R is the radius of the roll x is the axial position with respect to the center of the roll (=distance from the center of the roll)

$R_0$ is the roll radius offset

A is the contour coefficient

ϕ is the contour angle c is the contour displacement $L_{REF}$ is the camber reference length B is the tilting coefficient and the roll gap contour is formed by a cosine function derived from the sine function in a manner corresponding to the general equation $$G(x, s) = G_0 \div 2 * A * \cos\left(\frac{2 * \phi * x}{L_{REF}}\right) * \sin\left(\frac{2 * \phi * (s - c)}{L_{REF}}\right) + 2 * B * (s - c)$$

where s is the displacement of the upper roll from the central position $G_0$ is the roll gap offset.

3. The rolling stand of claim 2, wherein the second rolls comprise backup rolls, and a respective one of the backup rolls is in engagement with each of the work rolls for urging each of the work rolls toward the roll gap.

4. The rolling stand of claim 2, wherein the second rolls comprise intermediate rolls, and a respective one of the intermediate rolls is in engagement with each of the work rolls for urging each of the work rolls toward the roll gap;

a respective backup roll in engagement with each of the intermediate rolls for urging the respective intermediate roll toward the respective work roll.

5. The rolling stand of claim 2, wherein the trigonometric function of each roll is defined by a sine function, and the roll gap contour of the work rolls is defined by a cosine function derived from the sine function.

6. The rolling stand of claim 1, wherein the trigonometric function of each work roll is defined by a sine function, and the roll gap contour of the work rolls is defined by a cosine function derived from the sine function.

7. The rolling stand of claim 2, wherein the barrel contour of the two second rolls is such that the two barrel contours complement one another inside the axial displacement region of the rolls.

8. The rolling stand of claim 1, wherein the barrel contour of the two rolls is such that the two barrel contours complement one another inside the axial displacement region of the rolls.

9. The rolling stand as claimed in claim 2, wherein the barrel contour of the two second rolls is such that the two barrel contours complement one another outside the axial displacement region of the rolls.

10. The rolling stand as claimed in claim 1, wherein the barrel contour of the two work rolls is such that the two barrel contours complement one another outside the axial displacement region of the rolls.

11. The rolling stand as claimed in claim 1, wherein with a given camber reference length ($L_{REF}$) for the curved barrel contour of the roll, the contour angle ($\phi$) corresponds to the condition $0° < \phi \leqq 180°$.

12. The rolling stand as claimed in claim 1, wherein with a given camber reference length ($L_{REF}$) for the curved barrel contour of the roll, the contour angle ($\phi$) corresponds to the condition $50° \leqq \phi \leqq 80°$.

13. The rolling stand as claimed in claim 1, wherein the tilting coefficient (B) in the equation for the barrel contour of each roll is selected such that the maximum difference in diameter of the barrel contours within the camber reference length or the barrel length is at a minimum.

14. The rolling stand as claimed in claim 1, wherein the tilting coefficient (B) in the equation for the barrel contour of each roll is such that the maximum difference in diameter of the barrel contours within the camber reference length or the barrel length is at a minimum.

15. The rolling stand as claimed in claim 2, wherein the tilting coefficient (B) in the equation for the barrel contour of each roll is such that the maximum difference in diameter of the barrel contours within the camber reference length or the barrel length is at a minimum.

16. The rolling stand as claimed in claim 2, further comprising actuators operable to influence the barrel contour of the second rolls at least in certain portions, the actuators being positioned at the rolling stand in operative connection with the second rolls.

17. The rolling stand as claimed in claim 16, wherein the actuators comprise work roll cooling or zone cooling.

18. The rolling stand as claimed in claim. 1, further comprising actuators operable to influence the barrel contour at least in certain portions, the actuators being positioned at the rolling stand in operative connection with the two roll.

19. The rolling stand as claimed in claim 17, wherein the actuators comprise work roll cooling or zone cooling.

20. The rolling stand of claim 2, further comprising a control device for controlling the profile or flatness of the strip produced by the work rolls; a displacement device connected with the second rolls and operable by the control device for axially displacing the second rolls with respect to each other.

21. The rolling stand of claim 20, wherein the control device further comprises a measuring device for sensing the state of the strip being rolled.

22. The rolling stand of claim 1, further comprising a control device for controlling the profile or flatness of the strip produced by the work rolls; a displacement device connected with the two work rolls and operable by the control device for axially displacing the work rolls with respect to each other.

23. The rolling stand of claim 22, wherein the control device further comprises a measuring device for sensing the state of the strip being rolled.

24. The rolling stand of claim 20, wherein the control device further comprises a respective computing unit which uses mathematical models or a neural network to generate control signals for correction of the positions of the second rolls.

25. The rolling stand of claim 20, wherein the control device further comprises a respective computing unit which uses mathematical models or a neural network to generate control signals for correction of the positions of the second rolls.

26. A rolling stand for producing rolled strip, comprising:

a stand for supporting rolls; two work rolls supported in the stand and oriented to define a roll gap between which a strip is rolled;

a pair of second rolls, each second roll being outward of and in pressing engagement on a respective one of the work rolls for urging the work rolls toward the roll gap for producing the rolled strip;

each second roll having a respective effective barrel length and having a respective curved barrel contour running over the entire effective barrel length of the second roll, wherein the respective barrel contours of each of the second rolls complement one another when the second rolls are in a specific relative axial position of the second rolls in an unloaded state;

the second rolls pressing on the work rolls for defining respective curved contours of the work rolls corresponding to the respective curved contours of the second rolls in engagement with the work rolls;

the second rolls defining the work rolls to be so shaped that the profile of the barrel contour of each of the work rolls is formed according to a trigonometric function, and defining the roll gap between the work rolls to have a contour that is also formed by a trigonometric function which is dependent upon the profile of the barrel contour of the work rolls and upon the axial position of the work rolls within an axial displacement region thereof wherein the trigonometric function of the barrel contour is a tilted sine function corresponding to the general equation $$R(x)=R_0+A*\sin(2*\phi*(x+c)/L_{REF})+B*(x+c)$$

where

R is the radius of the roll x is the axial position with respect to the center of the roll (=distance from the center of the roll)

$R_0$ is the roll radius offset

A is the contour coefficient $\phi$ is the contour angle c is the contour displacement $L_{REF}$ is the camber reference length B is the tilting coefficient and the roll gap contour is formed by a cosine function derived from the sine function in a manner corresponding to the general equation $$G(x\cdot s)=G_0+2*A*\cos(2*\phi*x/L_{REF})*\sin(2*\phi*(s-c)/L_{REF})+2*B*(s-c)$$

where s is the displacement of the upper roll from the central position $G_0$ is the roll gap offset.

27. A rolling stand for producing rolling strip, comprising:

a stand for supporting rolls; two work rolls supported in the stand and oriented to define a roll gap between which a strip is rolled;

each work roll of the two work rolls having a respective effective barrel length and having a respective curved barrel contour extending axially over the entire effective barrel length of the work rolls, wherein the respective barrel contours complement one another when the work rolls are in a specific relative axial position in an unloaded state; the work rolls being supported in the stand for being axially displaceable with respect to one another;

the respective barrel contour of each of the two work rolls is formed according to a trigonometric function; the roll gap between the two work rolls having a contour that is also formed by a trigonometric function which is dependent upon a profile of the barrel contour and upon the axial position of the work rolls within an axial displacement region thereof;

a pair of second rolls, each second roll being outward of and in pressing engagement on a respective one of the work rolls for urging the work rolls toward the roll gap for producing the rolled strip; the second rolls pressing on the work rolls for defining the respective barrel curved contours of the work rolls corresponding to respective curved contours of the second rolls in engagement with the work rolls;

each second roll having a respective effective barrel length and having a respective curved barrel contour running over the entire effective barrel length of the second roll, wherein the respective barrel contour of each of the second rolls complements the contour of the other second roll and the respective contour of the barrel contour of the respective one of the work rolls engaged by each second roll complements the respective second roll when both the work rolls and the second rolls are in specific relative axial positions of the work rolls and the second rolls in an unloaded state;

the second rolls defining the work rolls to be so shaped that the profile of the barrel contour of each of the work rolls is formed according to a trigonometric function, and defining the roll gap between the work rolls to have a contour that is also formed by a trigonometric function which is dependent upon the profile of the barrel contour of the second rolls and upon the axial position of the work rolls within an axial displacement region thereof wherein the trigonometric function of the barrel contour is a tilted sine function corresponding to the general equation $$R(x)=R_0+A*\sin(2*\phi*(x+c)/L_{REF})+B*(x+c)$$

where

R is the radius of the roll x is the axial position with respect to the center of the roll (=distance from the center of the roll)

$R_0$ is the roll radius offset

A is the contour coefficient $\phi$ is the contour angle c is the contour displacement $L_{REF}$ is the camber reference length B is the tilting coefficient and the roll gap contour is formed by a cosine function derived from the sine function in a manner corresponding to the general equation $$G(x\cdot s)=G_0+2*A*(2*\phi*x/L_{REF})*\sin(2*\phi*(s-c)/L_{REF})+2*B*(s-c)$$

where s is the displacement of the upper roll from the central position $G_0$ is the roll gap offset.

28. A rolling stand for producing rolling strip, comprising:

a stand for supporting rolls; two work rolls supported in the stand and oriented to define a roll gap between which a strip is rolled;

each work roll of the two work rolls having a respective effective barrel length and having a respective curved barrel contour extending axially over the entire effective barrel length of the work rolls, wherein the respective barrel contours complement one another when the work rolls are in a specific relative axial position in an unloaded state; the work rolls being supported in the stand for being axially displaceable with respect to one another;

the respective barrel contour of each of the two work rolls is formed according to a trigonometric function; the roll gap between the two work rolls having a contour that is also formed by a trigonometric function which is dependent upon a profile of the barrel contour and upon the axial position of the work rolls within an axial displacement region thereof;

a pair of intermediate rolls, each intermediate roll being outward of and in pressing engagement on a respective one of the work rolls for urging the work rolls toward the roll gap for producing the rolled strip; the intermediate rolls pressing on the work rolls for defining the respective curved barrel contours of the work rolls corresponding to respective curved contours of the intermediate rolls in engagement with the work rolls;

each intermediate roll having a respective effective barrel length and having a respective curved barrel contour running over the entire effective barrel length of the intermediate roll, wherein the respective barrel contour of each of the intermediate rolls complements the contour of the other intermediate roll and the respective barrel contour of the respective one of the work rolls engaged by each intermediate roll complements the respective contour of the intermediate roll when both the work rolls and the intermediate rolls are in specific relative axial positions of the work rolls and the intermediate rolls in an unloaded state;

the intermediate rolls defining the work rolls to be so shaped that the profile of the barrel contour of each of the work rolls is formed according to a trigonometric function, and defining the roll gap between the work rolls to have a contour that is also formed by a trigonometric function which is dependent upon the profile of the barrel contour of the intermediate rolls and upon the axial position of the work rolls within an axial displacement region thereof;

a respective backup roll in engagement with each of the intermediate rolls for urging the respective intermediate roll toward the respective work roll; each backup roll having a respective effective barrel length and having a respective curved barrel contour running over the entire effective barrel length of the backup roll, wherein the respective barrel contour of each of the backup rolls complements the contour of the other backup roll and the respective barrel contour of the respective one of the intermediate rolls engaged by each backup roll complements the respective backup roll when all of the work rolls, the intermediate rolls and the backup rolls are in specific relative axial positions of the work rolls the intermediate rolls and the backup rolls in an unloaded state;

the intermediate rolls and the backup rolls defining the work rolls to be so shaped that the profile of the barrel contour of each of the work rolls is formed according to a trigonometric function, and defining the roll gap between the work rolls to have a contour that is also formed by a trigonometric function which is dependent upon the profile of the barrel contour of the intermediate rolls and the backup rolls and upon the axial positions of the work rolls, the intermediate rolls and the backup rolls within an axial displacement region thereof wherein the trigonometric function of the barrel contour is a tilted sine function corresponding to the general equation $$R(x)=R_0+A*\sin(2*\phi*(x+c)/L_{REF})+B*(x+c)$$

where

R is the radius of the roll x is the axial position with respect to the center of the roll (=distance from the center of the roll)

$R_0$ is the roll radius offset

A is the contour coefficient $\phi$ is the contour angle c is the contour displacement $L_{REF}$ is the camber reference length B is the tilting coefficient and the roll gap contour is formed by a cosine function derived from the sine function in a manner corresponding to the general equation $$G(x\cdot s)=G_0+2*A*\cos(2*\phi*x/L_{REF})*\sin(2*\phi*(s-c)/L_{REF})+2*B*(s-c)$$

where s is the displacement of the upper roll from the central position $G_0$ is the roll gap offset.

* * * * *